US011136701B2

(12) United States Patent
Tan et al.

(10) Patent No.: US 11,136,701 B2
(45) Date of Patent: Oct. 5, 2021

(54) NEEDLE BAR MECHANISM OF SEWING MACHINE

(71) Applicant: JUKI CORPORATION, Tama (JP)

(72) Inventors: Nguyen Ngoc Tan, Ho Chi Minh (VN); Nguyen Le Truong, Ho Chi Minh (VN)

(73) Assignee: JUKI CORPORATION, Tama (JP)

( * ) Notice: Subject to any disclaimer, the term of this patent is extended or adjusted under 35 U.S.C. 154(b) by 172 days.

(21) Appl. No.: 16/568,329

(22) Filed: Sep. 12, 2019

(65) Prior Publication Data

US 2020/0087826 A1 Mar. 19, 2020

(30) Foreign Application Priority Data

Sep. 18, 2018 (VN) ..... 1-2018-04116

(51) Int. Cl.
*D05B 3/02* (2006.01)
*D05B 69/22* (2006.01)
*D05B 55/16* (2006.01)

(52) U.S. Cl.
CPC ..... *D05B 3/025* (2013.01); *D05B 55/16* (2013.01); *D05B 69/22* (2013.01)

(58) Field of Classification Search
CPC ..... D05B 3/02; D05B 3/025; D05B 69/22; D05B 55/10; D05B 55/14; D05B 55/16
See application file for complete search history.

(56) References Cited

U.S. PATENT DOCUMENTS

| | | | | | |
|---|---|---|---|---|---|
| 3,815,532 | A * | 6/1974 | Weisz | D05B 55/16 | 112/221 |
| 4,569,297 | A * | 2/1986 | Dusch | D05B 55/16 | 112/221 |
| 5,003,899 | A * | 4/1991 | Ogawa | D05B 55/16 | 112/221 |
| 6,145,457 | A * | 11/2000 | Imaeda | D05B 69/22 | 112/221 |
| 2012/0205215 | A1 * | 8/2012 | Tseng | D05B 55/14 | 192/83 |

FOREIGN PATENT DOCUMENTS

JP 2006-87578 A 4/2006

* cited by examiner

*Primary Examiner* — Nathan E Durham
(74) *Attorney, Agent, or Firm* — Faegre Drinker Biddle & Reath LLP

(57) ABSTRACT

A needle bar mechanism includes a needle bar connecting stud, two needle bars, needle bar clutches, clutch levers, needle bar clutch stoppers, and deactivating members provided two by two at the stud; a slider configured to selectively collide with one clutch lever and one deactivating member at the time of lifting of the stud; and an interlocking mechanism configured to interlock the deactivating members such that the deactivating members move opposite to each other in an upper-to-lower direction. According to the needle bar mechanism, the slider comes, at the time of lifting of the stud, into collision with the clutch lever and the deactivating member, so that one needle bar clutch can be switched from a holding state to a release state by the stud while the other needle bar clutch is switched from the release state to the holding state by the stud.

18 Claims, 14 Drawing Sheets

NEEDLE BAR MECHANISM OF SEWING MACHINE

CROSS-REFERENCE TO RELATED APPLICATIONS

The present application claims the benefit of priority of Vietnamese Patent Application No. 1-2018-04116, filed on Sep. 18, 2018, the content of which is incorporated herein by reference.

BACKGROUND

1. Technical Field

The present invention relates to a needle bar mechanism of a sewing machine for selectively using two needle bars to perform sewing.

2. Description of the Related Art

A needle bar mechanism of a two-needle sewing machine having the one-needle stop function of selecting stopping upper-to-lower movement of a pair of needle bars includes the pair of needle bars having first and second engagement holes, a needle bar support body configured to separately support the pair of needle bars such that the pair of needle bars is movable up and down, a needle bar upper-to-lower movement mechanism configured to move each needle bar up and down by means of a needle bar connecting stud configured to separately hold the pair of needle bars, a clutch mechanism configured to switch between a holding state and a release state by the needle bar connecting stud, and an anti-drop mechanism configured to hold the needle bar in the release state by the needle bar connecting stud at an upper standby position (see, e.g., JP-A-2006-087578).

FIG. 13 is a front view of a typical clutch mechanism 100 switching a left needle bar 101 from a release state to a holding state. FIG. 14 is a front view of the typical clutch mechanism 100 switching a right needle bar 101 from the holding state to the release state. FIG. 15 is a side view of the typical clutch mechanism 100 in the release state. FIG. 16 is a side view of the typical clutch mechanism 100 switched from the release state to the holding state. FIG. 17 is a side view of the typical clutch mechanism 100 in the holding state. FIG. 18 is a side view of the typical clutch mechanism 100 switched from the holding state to the release state. In the figures, "U" indicates an upper side, "D" indicates a lower side, "L" indicates a left side, "R" indicates a right side, "F" indicates a front side, and "B" indicates a back side.

A typical sewing machine has independent clutch mechanisms each corresponding to the right and left needle bars 101.

This clutch mechanism includes a clutch lever 102, a needle bar clutch 103 and a needle bar clutch stopper 104, a release pin 105, and a slider 106.

A not-shown needle bar connecting stud is moved up and down by a sewing machine motor.

The needle bar clutch 103 is supported to move back and forth. When the needle bar clutch 103 retreats, a back end portion is fitted in a fitting hole 101*a* formed at the needle bar 101 (see FIGS. 16 and 17). A not-shown lever member is built in the needle bar 101. When the back end portion of the needle bar clutch 103 is fitted in the fitting hole 101*a*, the lever member is pressed and rotated. Accordingly, an anti-drop mechanism configured to hold the needle bar 101 at an upper standby position can be deactivated. Moreover, the back end portion of the needle bar clutch 103 is fitted in the fitting hole 101*a*, and in this manner, the needle bar connecting stud and the needle bar 101 are coupled to each other via the needle bar clutch 103. Thus, the needle bar 101 can move up and down together with the needle bar connecting stud.

The clutch lever 102 forms a bell crank, and is supported by the needle bar connecting stud to rotate about an axis along a right-to-left direction. Moreover, a lower end portion of the clutch lever 102 is coupled to a front end portion of the needle bar clutch 103. An upper end portion of the clutch lever 102 is pressed upward by a spring 107 such that the needle bar clutch 103 retreats toward the fitting hole 101*a*.

The slider 106 is slidable in the right-to-left direction. A protruding portion 106*a* of the slider 106 can be selectively arranged right above each of the left clutch lever 102, the right clutch lever 102, and the release pin 105.

A front end portion of the needle bar clutch stopper 104 is supported by the needle bar connecting stud to rotate about an axis along the right-to-left direction. Moreover, an upward claw 104*a* is provided at a back end portion of the needle bar clutch stopper 104. In addition, the back end portion of the needle bar clutch stopper 104 is pressed upward by a spring 108.

The claw 104*a* of the needle bar clutch stopper 104 can be locked at the back end portion of the needle bar clutch 103. Thus, the locked needle bar clutch 103 is restricted from retreating. Moreover, the needle bar clutch 103 is held in a state in which the needle bar clutch 103 cannot be fitted in the fitting hole 101*a* of the needle bar 101.

The release pin 105 is supported by the needle bar connecting stud to move up and down. In addition, the release pin 105 is arranged so that a lower end portion thereof can contact a back end upper portion of the needle bar clutch stopper 104. Note that the release pin 105 is arranged so that the release pin 105 can contact any of the right and left needle bar clutch stoppers 104.

For example, in a case where the typical needle bar mechanism switches the right needle bar 101 in the holding state to the release state and switches the left needle bar 101 in the release state to the holding state, the protruding portion 106*a* of the slider 106 is first arranged right above the release pin 105 as illustrated in FIG. 13.

When the needle bar connecting stud is lifted in this state, a state of FIG. 15 transitions to a state of FIG. 16. That is, the protruding portion 106*a* of the slider 106 collides with an upper end portion of the release pin 105. Then, the protruding portion 106*a* pushes up the claw 104*a* of the back end portion of the left needle bar clutch stopper 104, thereby releasing the needle bar clutch 103. Accordingly, the clutch lever 102 is rotated by upward biasing of the spring 107. Thus, the back end portion of the needle bar clutch 103 is pushed into the fitting hole 101*a* of the left needle bar 101. In this manner, the left needle bar 101 is switched to the holding state.

By retreating of the needle bar clutch 103, a lower end portion of the lever member in the left needle bar 101 rotates backward. Then, the needle bar 101 in the holding state by the anti-drop mechanism is released. Thus, the left needle bar 101 is movable up and down together with the needle bar connecting stud.

Next, as illustrated in FIG. 14, the protruding portion 106*a* of the slider 106 is arranged right above the right side clutch lever 102.

When the needle bar connecting stud is lifted in this state, a state of FIG. 17 transitions to a state of FIG. 18. That is, the protruding portion 106*a* of the slider 106 collides with the upper end portion of the right side clutch lever 102. By rotation of the clutch lever 102, the needle bar clutch 103 advances. Then, the back end portion of the needle bar clutch 103 is pulled out of the fitting hole 101*a* of the right needle bar 101. In this manner, the right needle bar 101 is switched to the release state.

The claw 104*a* of the needle bar clutch stopper 104 biased upward by the spring 108 is locked at the back end portion of the advanced needle bar clutch 103. In this manner, the needle bar clutch 103 is held not to retreat.

By advancing of the needle bar clutch 103, the lower end portion of the lever member in the right needle bar 101 rotates forward. Then, by the anti-drop mechanism, the needle bar 101 is held at the upper standby position.

As described above, switching of the right and left needle bars is performed.

SUMMARY

However, as described above, in the case of switching the right and left needle bars to be moved up and down, the typical needle bar mechanism needs to cause the protruding portion 106*a* of the slider 106 to collide with the release pin 105, thereby switching the needle bar 101 from the release state to the holding state. Subsequently, the typical needle bar mechanism needs to cause the protruding portion 106*a* of the slider 106 to collide with the clutch lever 102 in the holding state, thereby switching the needle bar 101 from the holding state to the release state.

Thus, in the case of switching the right and left needle bars to be moved up and down during sewing, the slider 106 needs to be collided twice. Thus, this causes a problem that, between these collisions, simultaneous needle locations of both of the right and left needle bars certainly occurs.

This case cannot respond to a demand for complete needle handling only with one needle.

The present invention is intended to perform switching from one needle bar to the other needle bar without simultaneous needle location of two needle bars.

A needle bar mechanism of a sewing machine according to the present invention, including a needle bar connecting stud 14, two needle bars 11, a slider 26, and an interlocking mechanism 25, wherein the needle bar connecting stud 14 includes, corresponding to the two needle bars 11, two needle bar clutches 22, two clutch levers 21, two needle bar clutch stoppers 23, and two deactivating members 24, the slider 26 is configured to selectively collide, at the time of lifting of the needle bar connecting stud 14, with the clutch lever 21 and the deactivating member 24 corresponding to either one of the two needle bars 11, thereby pushing down the clutch lever 21 and the deactivating member 24, each needle bar clutch 22 is configured such that the needle bar 11 is held by the needle bar connecting stud 14 by fitting of the needle bar clutch 22 into a fitting hole 112 provided at the needle bar 11, each clutch lever 21 is, at a center portion thereof, rotatably supported by the needle bar connecting stud 14, one end of each clutch lever 21 is biased upward by a clutch spring 211, another end of each clutch lever 21 is coupled to the needle bar clutch 22, each clutch lever 21 is configured such that when the clutch lever 21 is selectively pushed down by the slider 26, the needle bar clutch 22 fitted in the fitting hole 112 is separated from the fitting hole 112 by rotation operation of the clutch lever 21, each needle bar clutch stopper 23 is, at a center portion thereof, rotatably supported by the needle bar connecting stud 14, one end of each needle bar clutch stopper 23 is inserted into a frame portion 241 provided at the deactivating member 24, another end of each needle bar clutch stopper 23 has a claw 231, and is biased toward the needle bar clutch 22 by a stopper spring 232, each needle bar clutch stopper 23 is configured such that when the corresponding deactivating member 24 is selectively pushed down by the slider 26, the claw 231 is locked at a groove 222 provided at the needle bar clutch 22 to restrict movement of the needle bar clutch 22 into the fitting hole 112, each deactivating member 24 is configured such that the claw 231 locked at the groove 222 is separated from the groove 222 by the rotating needle bar clutch stopper 23 rotated by contact between one end of the needle bar clutch stopper 23 and an inner side lower portion 241*a* of the frame portion 241 at the time of lifting of the deactivating member 24, and the interlocking mechanism 25 is configured to interlock the two deactivating members 24 such that one of the deactivating members 24 is lifted when the other deactivating member 24 is selectively pushed down.

With the above-described configuration, the present invention can switch two needle bars held by the needle bar connecting stud by single simultaneous collision between the clutch lever and the deactivating member.

Thus, occurrence of simultaneous needle location of two needle bars can be avoided.

DESCRIPTION OF THE EMBODIMENTS

[Entire Configuration of Embodiment of the Invention]

Hereinafter, an embodiment of the present invention will be described in detail with reference to FIGS. 1 to 11.

Figure 1:
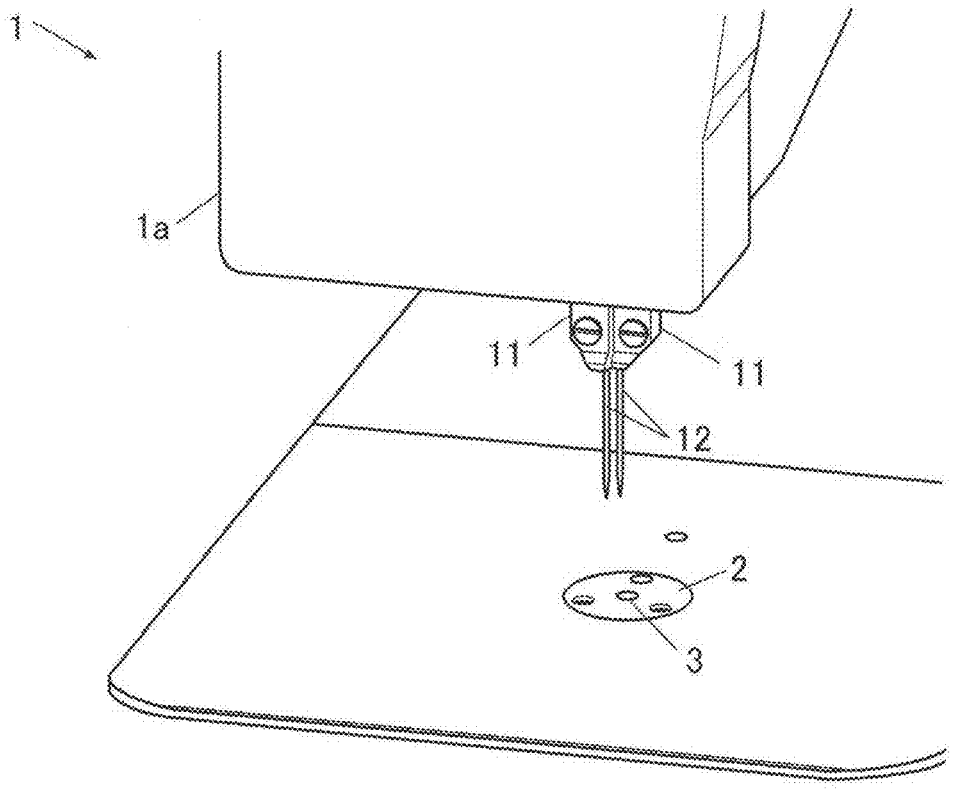
FIG. 1 is a perspective view of the periphery of sewing needles of a sewing machine.

As illustrated in FIG. 1, a needle bar mechanism 10 described below is mounted on a sewing machine 1 configured to selectively use two needle bars 11. That is, the sewing machine 1 has only one pinhole 3 formed at a needle plate 2. In such a pinhole 3, only needle location of a sewing needle 12 held at any one of two needle bars 11 selected by the needle bar mechanism 10 can be performed.

[Needle Bar Mechanism]

Figure 2:
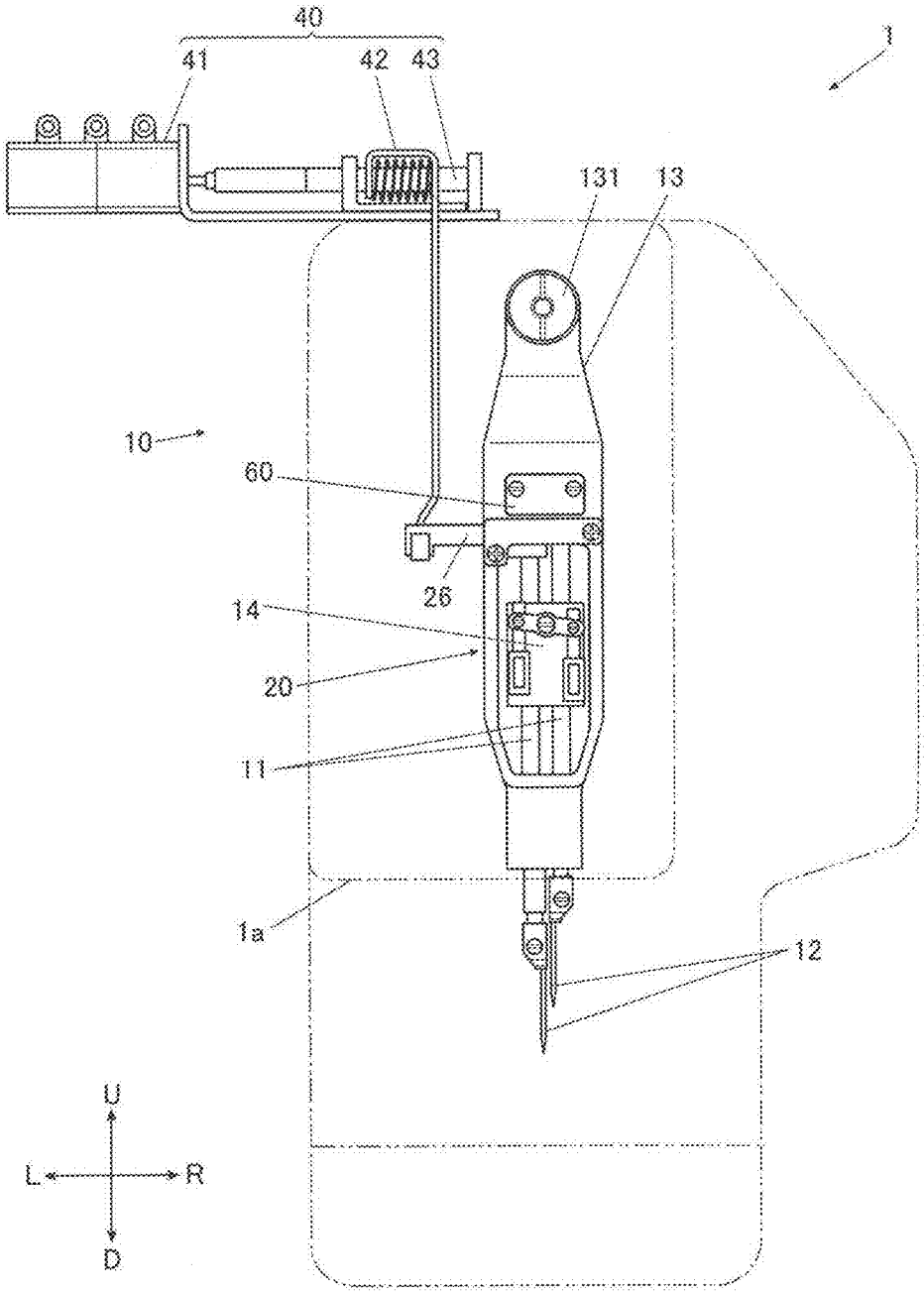
FIG. 2 is a front view of a needle bar mechanism.
Figure 3:
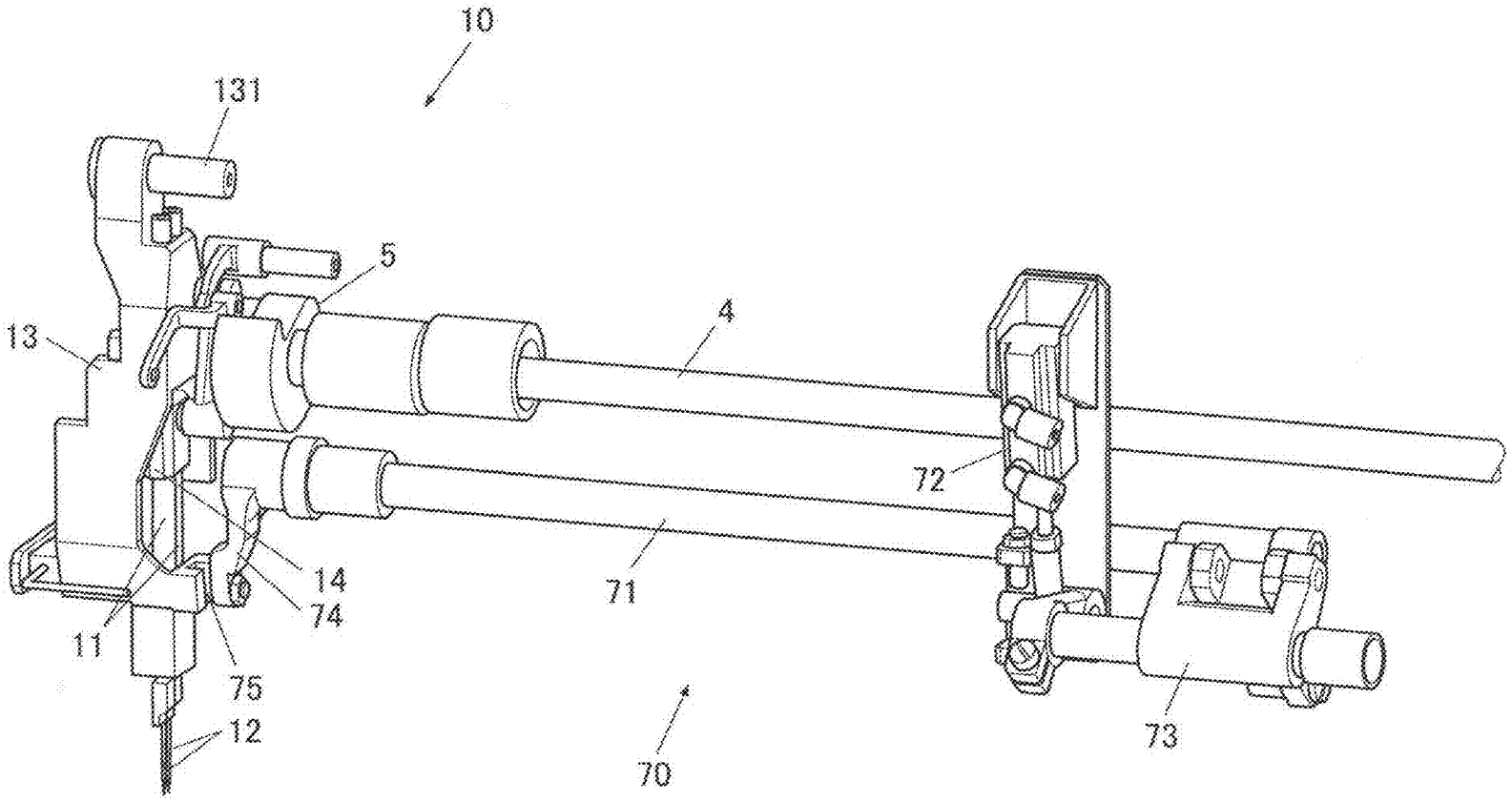
FIG. 3 is a perspective back view of the needle bar mechanism.
Figure 4:
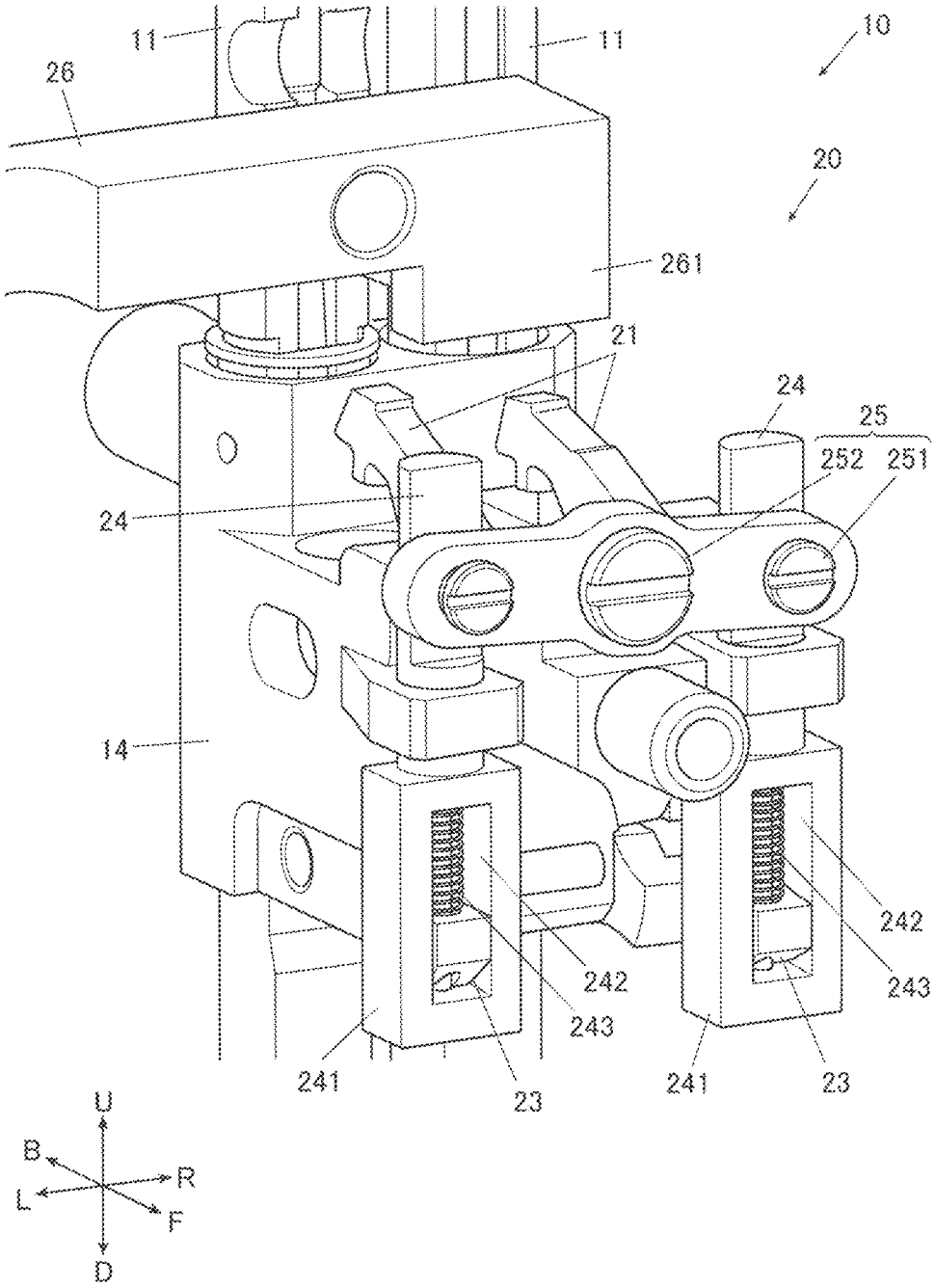
FIG. 4 is a perspective view of the periphery of a needle bar connecting stud.
Figure 5:
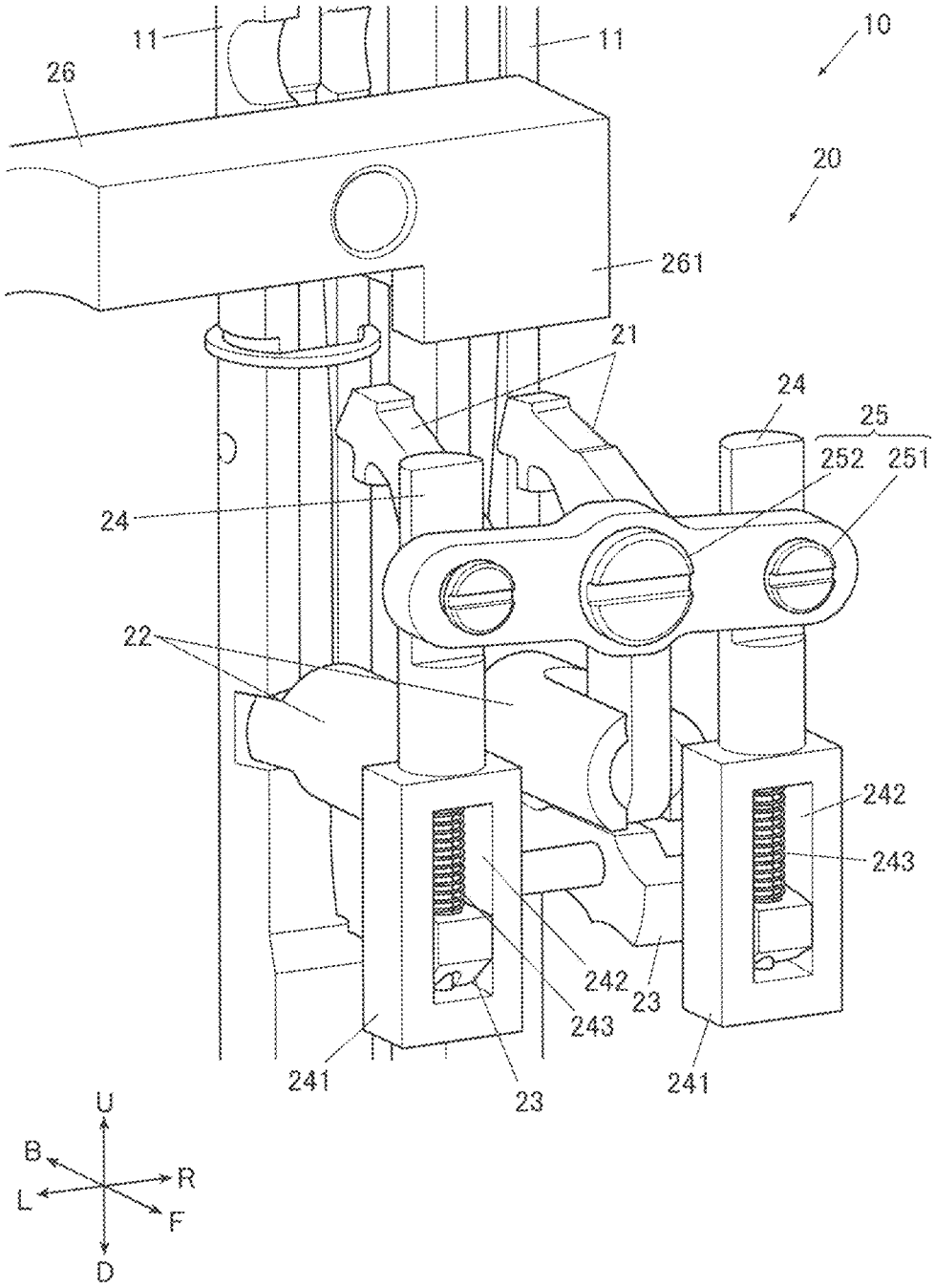
FIG. 5 is a perspective view of the periphery of the needle bar connecting stud.
Figure 6:
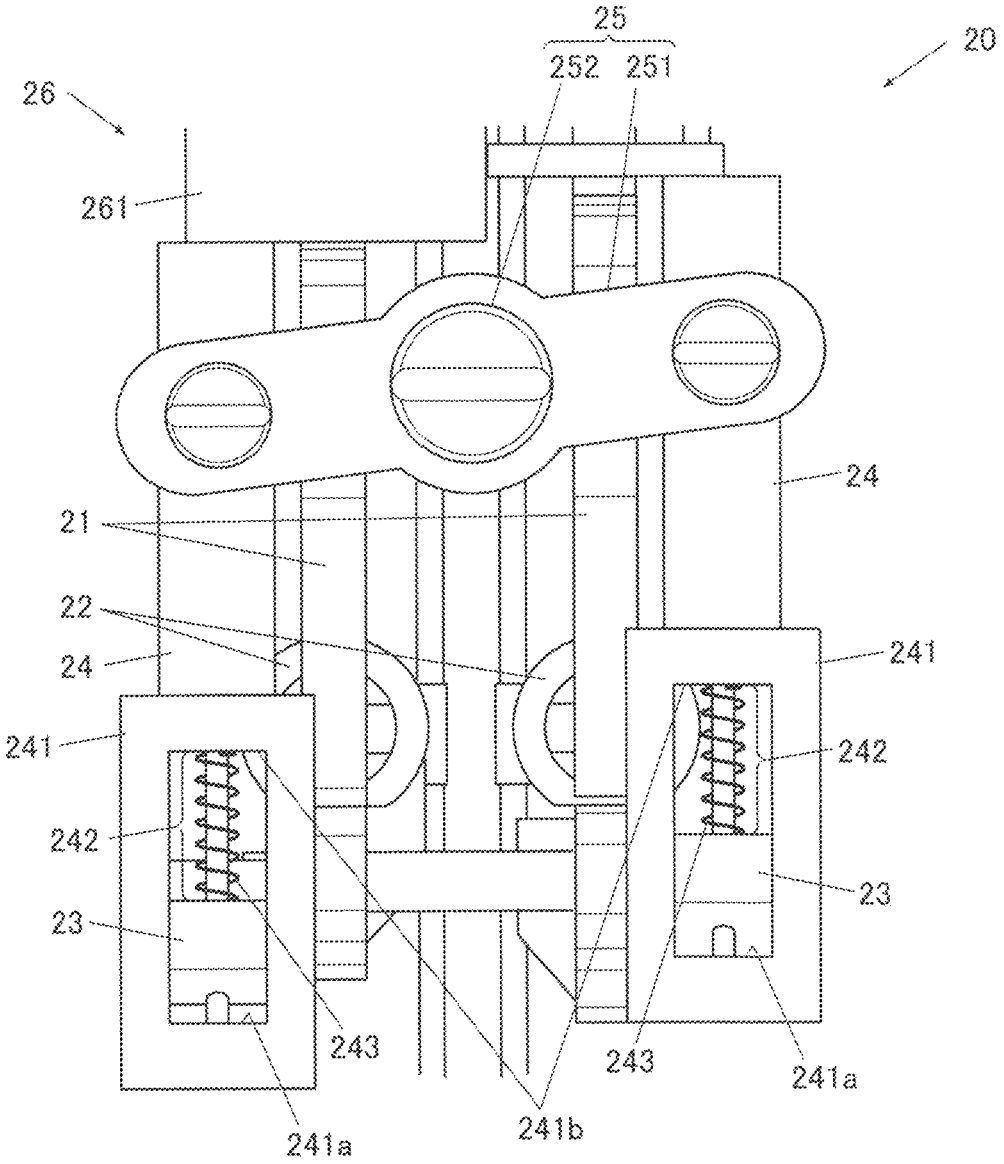
FIG. 6 is a front view of the needle bar connecting stud.

FIG. 2 is a front view of the needle bar mechanism 10. FIG. 3 is a perspective back view of the needle bar mechanism 10. FIGS. 4 and 5 are perspective views of the periphery of a needle bar connecting stud 14. FIG. 6 is a front view of a clutch mechanism 20. Note that the needle bar connecting stud 14 is not shown in FIGS. 5 and 6.

In description below, in the figures, "U" indicates an upper side, "D" indicates a lower side, "L" indicates a left side, "R" indicates a right side, "F" indicates a front side, and "B" indicates a back side.

The needle bar mechanism 10 includes a swinging frame 13, the needle bar connecting stud 14, the clutch mechanism 20, a needle bar switching mechanism 40, a needle bar holding mechanism 60, and a swinging mechanism 70.

The swinging frame 13 is configured to support two needle bars 11 such that two needle bars 11 are movable up and down.

The needle bar connecting stud 14 is configured to selectively hold two needle bars 11, thereby providing upper-to-lower reciprocation operation to the held needle bars 11.

The clutch mechanism 20 is configured to hold and release two needle bars 11 by the needle bar connecting stud 14.

The needle bar switching mechanism 40 is configured to input, to the clutch mechanism 20, switching between a holding state and a release state of two needle bars 11 by the needle bar connecting stud 14.

The needle bar holding mechanism 60 is configured to hold, at an upper standby position as a top dead point, the needle bar 11 released from the needle bar connecting stud 14 by the clutch mechanism 20.

The swinging mechanism 70 is configured to swing the swinging frame 13 to determine the positions of the right and left needle bars 11 such that needle location of the sewing needle 12 of one of two needle bars 11 at the pinhole 3 is allowed.

Hereinafter, these configurations will be described in detail.

[Swinging Frame]

As illustrated in FIG. 2, the swinging frame 13 is arranged inside a front end portion of a sewing machine arm portion 1*a* of the sewing machine 1. An upper end portion of the swinging frame 13 is swingably supported by a spindle 131 along a front-to-back direction.

The swinging frame 13 extends in an upper-to-lower direction in the sewing machine arm portion 1*a*. Moreover, the swinging frame 13 supports two needle bars 11 with two needle bars 11 being arranged parallel to each other in a right-to-left direction.

A lower end portion of the swinging frame 13 is swingable in the right-to-left direction by the spindle 131. Thus, the swinging frame 13 swings to the right side such that needle location of the sewing needle 12 of the left needle bar 11 at the pinhole 3 is allowed. Moreover, the swinging frame 13 swings to the left side such that needle location of the sewing needle 12 of the right needle bar 11 at the pinhole 3 is allowed.

Note that in each figure, the swinging frame 13 is not inclined. That is, the swinging frame 13 is at a neutral position. Thus, two needle bars 11 are parallel to each other along the upper-to-lower direction. The configuration of the swinging frame 13 and a peripheral configuration thereof in such a state are illustrated in the figure. Moreover, unless otherwise provided, the swinging frame 13 is assumed to be at the neutral position in description of each configuration below.

[Needle Bar Connecting Stud]

As illustrated in FIG. 2, the needle bar connecting stud 14 is movable up and down along the two needle bars 11 penetrating in the upper-to-lower direction. The needle bars 11 are held at the upper standby position by the needle bar holding mechanism 60.

Moreover, as illustrated in FIG. 3, an upper shaft 4 rotatable by a not-shown sewing machine motor provides upper-to-lower reciprocation operation to the needle bar connecting stud 14 via a needle bar crank 5.

The needle bar connecting stud 14 supports other configurations of the clutch mechanism 20 than a slider 26.

[Swinging Mechanism]

As illustrated in FIG. 3, the swinging mechanism 70 includes a swinging shaft 71 extending along the front-to-back direction in the sewing machine arm portion 1*a*, an air cylinder 72 configured to provide rotation operation to the swinging shaft 71, a transmission mechanism 73 having multiple link members coupling a piston rod of the air cylinder 72 and a back end portion of the swinging shaft 71, and a swinging arm 74 equipped at a front end portion of the swinging shaft 71 in a fixed manner.

The transmission mechanism 73 is configured to rotate, according to advancing and retreating movement operation of the piston rod of the air cylinder 72, the swinging shaft 71 clockwise or counterclockwise as viewed from the front within a predetermined angle range.

The swinging arm 74 extends downward from the swinging shaft 71. By rotation operation of the swinging shaft 71, an extending end portion of the swinging arm 74 rotates in the right-to-left direction.

At the rotating end portion of the swinging arm 74, a square piece 75 is equipped to rotate about an axis along the front-to-back direction. The square piece 75 is formed at a back surface of the lower end portion of the swinging frame 13, and is fitted in a square groove extending along the upper-to-lower direction. The square piece 75 is slidable along the square groove.

Clockwise or counterclockwise rotation operation of the swinging arm 74 is performed by the swinging shaft 71 and the air cylinder 72. At this point, the swinging arm 74 provides, via the square piece 75, leftward swing or rightward swing to the swinging frame 13. Accordingly, the position of the swinging frame 13 is determined at such a position that needle location of the sewing needle 12 of the right needle bar 11 at the pinhole 3 is allowed or such a position that needle location of the sewing needle 12 of the left needle bar 11 at the pinhole 3 is allowed.

When the swinging arm 74 rotates clockwise or counterclockwise, the rotating end portion of the swinging arm 74 generates displacement in the upper-to-lower direction. That is, the square piece 75 is slidable along the square groove of the swinging frame 13, and therefore, such displacement in the upper-to-lower direction is allowed.

[Needle Bar Holding Mechanism]

The needle bar holding mechanism 60 is built in an upper portion of the swinging frame 13. Each needle bar 11 has a holding hole formed at a front surface of the vicinity of an upper end portion of the needle bar 11. The needle bar holding mechanism 60 includes two not-shown fitting pins to be each fitted to the holding holes of the needle bars 11. These fitting pins are pressed backward by springs. Thus, when the needle bar 11 is lifted to the top dead point by the upper shaft 4 and the needle bar crank 5, the fitting pin is pushed into the holding hole. In this manner, the fitting pin can hold the needle bar 11 at the upper standby position.

Note that a lever member 111 is built in the needle bar 11 along a longitudinal direction thereof. The lever member 111 is, at a center portion thereof, rotatably supported by the needle bar 11, and therefore, upper and lower end portions of the lever member 111 are rotatable in the front-to-back direction. When the needle bar 11 is held at the needle bar connecting stud 14 by the clutch mechanism 20, the lower end portion of the lever member 111 is pressed backward by the clutch mechanism 20 (see FIG. 7). The upper end portion of the lever member 111 is pushed forward to close the above-described holding hole. Thus, when the needle bar 11 is held by the needle bar connecting stud 14, the needle bar holding mechanism 60 cannot hold the needle bar 11.

[Clutch Mechanism]

The clutch mechanism 20 includes clutch levers 21, needle bar clutches 22, needle bar clutch stoppers 23, deactivating members 24, an interlocking mechanism 25, and the slider 26.

Moreover, the clutch levers 21, the needle bar clutches 22, the needle bar clutch stoppers 23, and the deactivating members 24 are, one by one, separately provided corresponding to the right and left needle bars 11.

Figure 7:
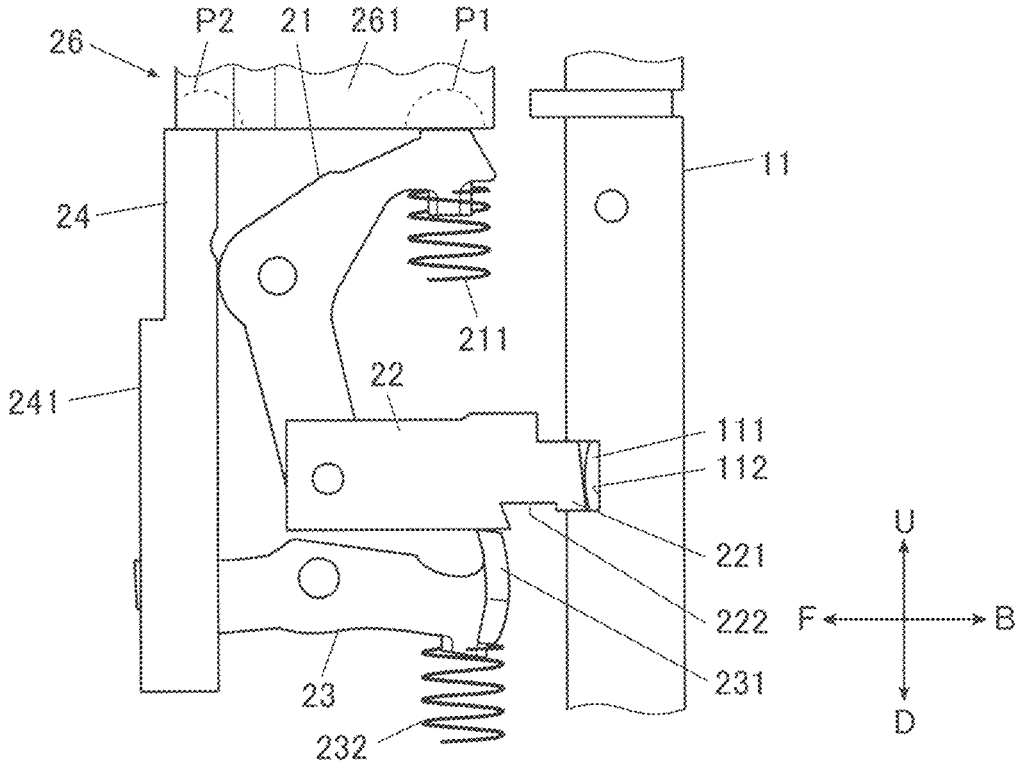
FIG. 7 is a right side view of a left clutch lever, a left needle bar clutch, a left needle bar clutch stopper, and a left deactivating member.
Figure 8:
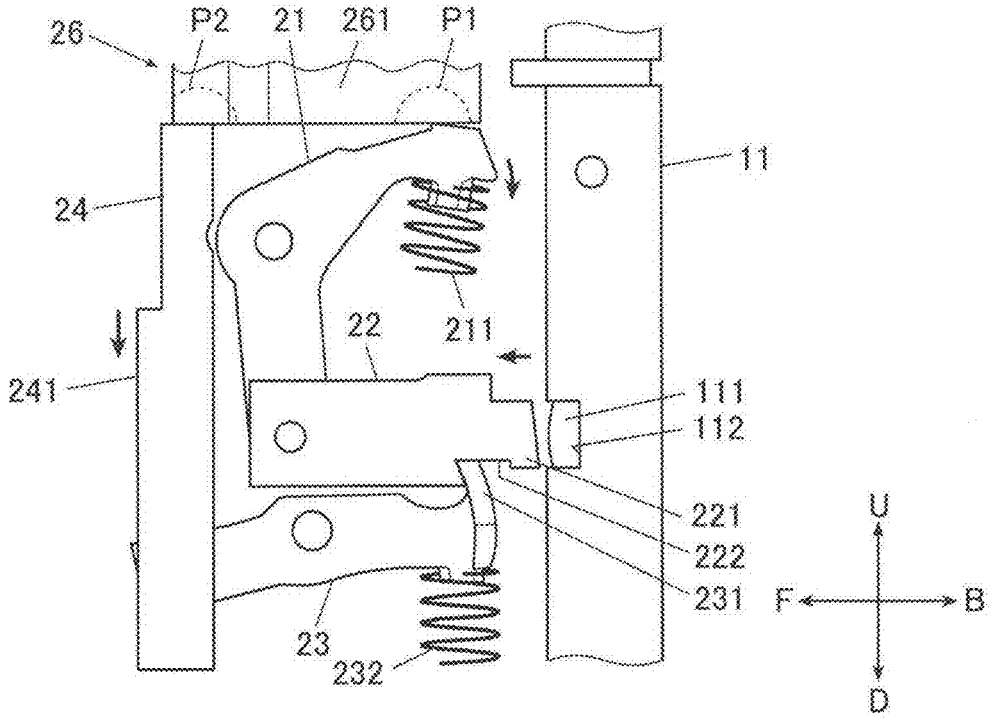
FIG. 8 is a right side view of the left clutch lever, the left needle bar clutch, the left needle bar clutch stopper, and the left deactivating member.
Figure 9:
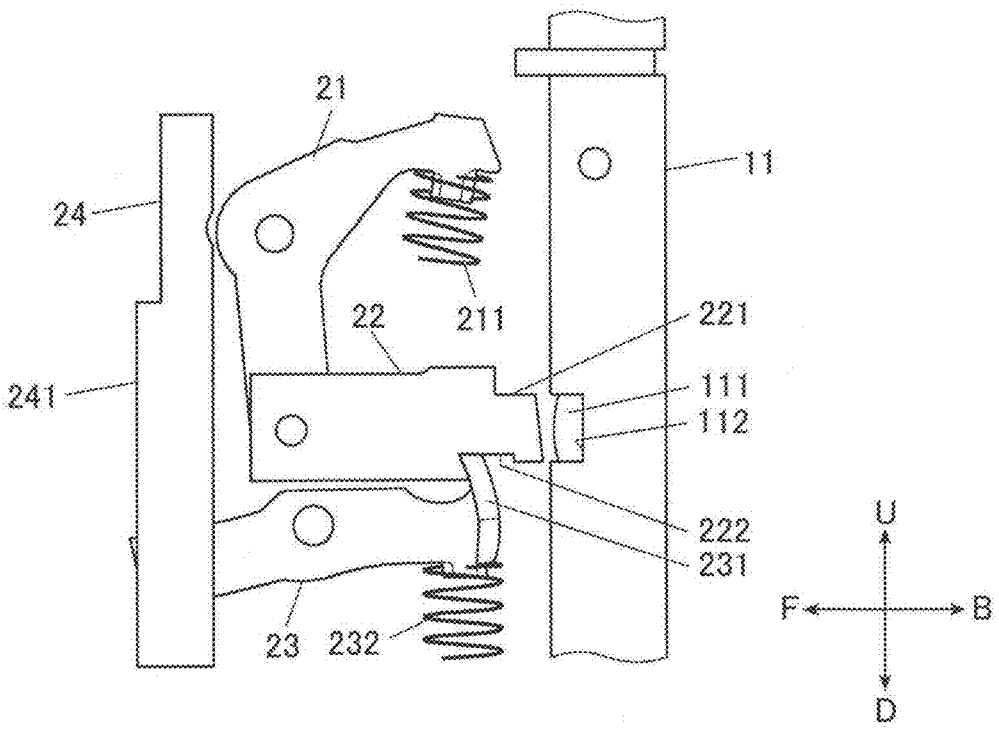
FIG. 9 is a right side view of a right clutch lever, a right needle bar clutch, a right needle bar clutch stopper, and a right deactivating member.
Figure 10:
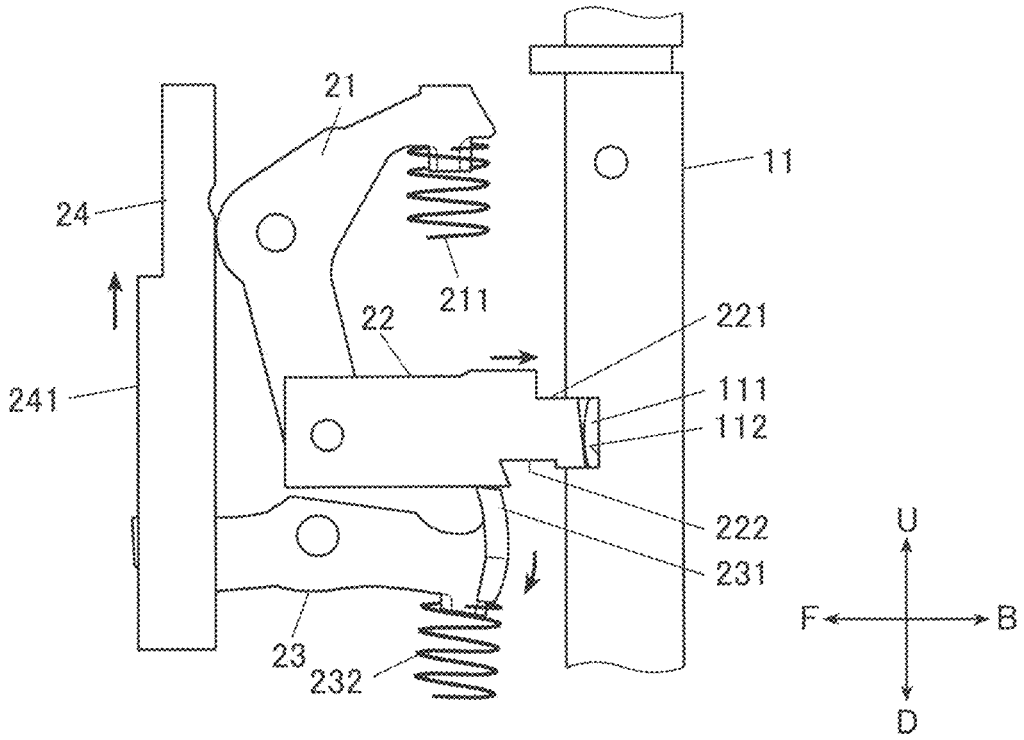
FIG. 10 is a right side view of the right clutch lever, the right needle bar clutch, the right needle bar clutch stopper, and the right deactivating member.

FIGS. 7 and 8 are right side views of the left clutch lever 21, the left needle bar clutch 22, the left needle bar clutch stopper 23, and the left deactivating member 24. FIGS. 9 and 10 are right side views of the right clutch lever 21, the right needle bar clutch 22, the right needle bar clutch stopper 23, and the right deactivating member 24. Note that in FIGS. 7 to 10, the needle bar connecting stud 14 is not shown in the figure.

The right and left needle bar clutches 22 can separately maintain the right and left needle bars 11 at the holding state by the needle bar connecting stud 14. By rotation operation, the right and left clutch levers 21 can separately switch the right and left needle bar clutches 22 from the holding state to the release state by the needle bar connecting stud 14. The right and left needle bar clutch stoppers 23 can separately restrict switching of the right and left needle bar clutches 22 to the holding state. By lifting of the right and left deactivating members 24, a switching restricted state of the right and left needle bar clutch stoppers 23 can be separately deactivated.

The interlocking mechanism 25 can interlock two deactivating members 24 such that these two deactivating members 24 move opposite to each other in the upper-to-lower direction.

The slider 26 is movable in the right-to-left direction. At the time of lifting of the needle bar connecting stud 14, the slider 26 can selectively come into collision with the left clutch lever 21 and the left deactivating member 24 or the right clutch lever 21 and the right deactivating member 24, thereby pushing these components downward.

Each needle bar clutch 22 is supported by the needle bar connecting stud 14 to move in the front-to-back direction. With this configuration, a back end portion of such a needle bar clutch 22 can move to be engaged with or disengaged from the needle bars 11 penetrating the needle bar connecting stud 14 in the upper-to-lower direction. When the needle bar clutch 22 retreats, a protrusion 221 of the back end portion is fitted in a fitting hole 112 formed at the needle bar 11 (see FIGS. 7 and 10). At this point, the lower end portion of the lever member 111 in the needle bar 11 is pushed backward into the fitting hole 112 by the protrusion 221 of the needle bar clutches 22. Meanwhile, the upper end portion of the lever member 111 pushes the fitting pin of the needle bar holding mechanism 60 forward. In a case where the needle bar 11 is held at the needle bar holding mechanism 60, such a holding state can be deactivated.

Moreover, by fitting of the protrusion 221 of the needle bar clutch 22 into the fitting hole 112, the needle bar connecting stud 14 and the needle bar 11 are coupled together via the needle bar clutch 22. The needle bar 11 moves up and down together with the needle bar connecting stud 14.

Each clutch lever 21 is bent at the center thereof as viewed in the right-to-left direction. Each clutch lever 21 forms a bell crank. A center portion of the clutch lever 21 is supported by the needle bar connecting stud 14 to rotate about an axis along the right-to-left direction. Further, a lower end portion of the clutch lever 21 is coupled to a front end portion of the needle bar clutch 22. Moreover, an upper end portion of the clutch lever 21 is pressed upward by a clutch spring 211. Thus, when the clutch lever 21 rotates, the upper end portion of the clutch lever 21 is biased such that the protrusion 221 of the needle bar clutch 22 retreats toward the fitting hole 112.

As described above, the upper end portion of the clutch lever 21 can collide with the slider 26. As illustrated in FIG. 8, the clutch lever 21 rotates against the clutch spring 211 by collision. In this manner, the protrusion 221 of the needle bar clutch 22 can be pulled forward out of the fitting hole 112.

Each needle bar clutch stopper 23 is, at a center portion thereof in the front-to-back direction, supported by the needle bar connecting stud 14. Each needle bar clutch stopper 23 is rotatable about an axis along the right-to-left direction. Moreover, an upward claw 231 is provided at a back end portion of the needle bar clutch stopper 23. In addition, the back end portion of the needle bar clutch stopper 23 is pressed upward by a stopper spring 232.

The claw 231 of the needle bar clutch stopper 23 can be locked at a groove 222 of the back end portion of the needle bar clutch 22. The needle bar clutch 22 locked by the claw 231 is restricted from retreating, and is held at a state in which the needle bar clutch 22 cannot be fitted in the fitting hole 112 of the needle bar 11.

Moreover, a front end portion of the needle bar clutch stopper 23 is coupled to the deactivating member 24.

As illustrated in FIG. 4, each deactivating member 24 extends along the upper-to-lower direction, and is supported to move up and down relative to the needle bar connecting stud 14.

As described above, an upper end portion of the deactivating member 24 can collide with the slider 26.

Moreover, a lower portion of the deactivating member 24 includes a rectangular frame portion 241 elongated in the upper-to-lower direction as viewed in the front-to-back direction. The front end portion of the needle bar clutch stopper 23 is inserted into the frame portion 241.

As illustrated in FIG. 6, only a slight clearance is present between an inner side lower portion 241*a* of the frame portion 241 and the needle bar clutch stopper 23, but a sufficient clearance 242 as an allowance is formed between an inner side upper portion 241*b* of the frame portion 241 and the needle bar clutch stopper 23. Moreover, a compression spring 243 as an elastic body is interposed in the clearance 242 between the inner side upper portion 241*b* of the frame portion 241 and the needle bar clutch stopper 23.

When an upper end portion of the deactivating member 24 comes into collision with the slider 26, the deactivating member 24 is pushed downward. However, the sufficient clearance 242 is present between the inner side upper portion 241*b* of the frame portion 241 and the needle bar clutch stopper 23, and therefore, the inner side upper portion 241*b* of the frame portion 241 and one end of the needle bar clutch stopper 23 do not contact each other. Thus, lowering operation of the deactivating member 24 is not interfered. Moreover, the compression spring 243 is interposed in the clearance 242. Thus, rattling of the front end portion of the needle bar clutch stopper 23 can be reduced.

The right and left deactivating members 24 are coupled to each other by the interlocking mechanism 25. When one deactivating member 24 is lowered, the other deactivating member 24 is lifted. By such lifting, the inner side lower portion 241*a* of the frame portion 241 and the needle bar clutch stopper 23 come into contact with each other as illustrated in FIGS. 9 and 10. In this manner, the front end portion of the needle bar clutch stopper 23 is lifted upward. Then, the needle bar clutch stopper 23 rotates about the axis such that the claw 231 holding the needle bar clutch 22 to restrict retreating of the needle bar clutch 22 is detached from the groove 222. In this manner, the needle bar clutch 22 retreats. Then, the protrusion 221 is fitted in the fitting hole 112 of the needle bar 11.

[Interlocking Mechanism]

As illustrated in FIGS. 4 to 6, the interlocking mechanism 25 has a spindle member 252 as the point of support of a center portion of a link member 251. Each of right and left end portions of the link member 251 is coupled to the vicinity of the upper end portion of a corresponding one of the deactivating members 24.

Each of the right and left end portions of the link member 251 is coupled to the upper end portion of the deactivating member 24 to rotate about an axis along the front-to-back direction.

The spindle member 252 is a hinge screw along the front-to-back direction. The link member 251 is supported to rotate about the axis along the front-to-back direction relative to the needle bar connecting stud 14.

By the interlocking mechanism 25, the right deactivating member 24 is lifted when the left deactivating member 24 is lowered, and the left deactivating member 24 is lifted when the right deactivating member 24 is lowered.

[Slider]

The slider 26 is arranged at the swinging frame 13. When the needle bar connecting stud 14 is lifted to the top dead point, the slider 26 is arranged at such a height that the upper end portions of the clutch lever 21 and the deactivating member 24 collide with the slider 26.

The slider 26 is supported by the swinging frame 13 to move in the right-to-left direction. Moreover, the position of the slider 26 is, by the needle bar switching mechanism 40, switched to any of three positions including a left position, a right position, and a neutral position therebetween. At the left position, the slider 26 collides with the left clutch lever 21 and the left deactivating member 24. At the right position, the slider 26 collides with the right clutch lever 21 and the right deactivating member 24. At the neutral position, the slider 26 does not collide with any of these components.

Figure 11:
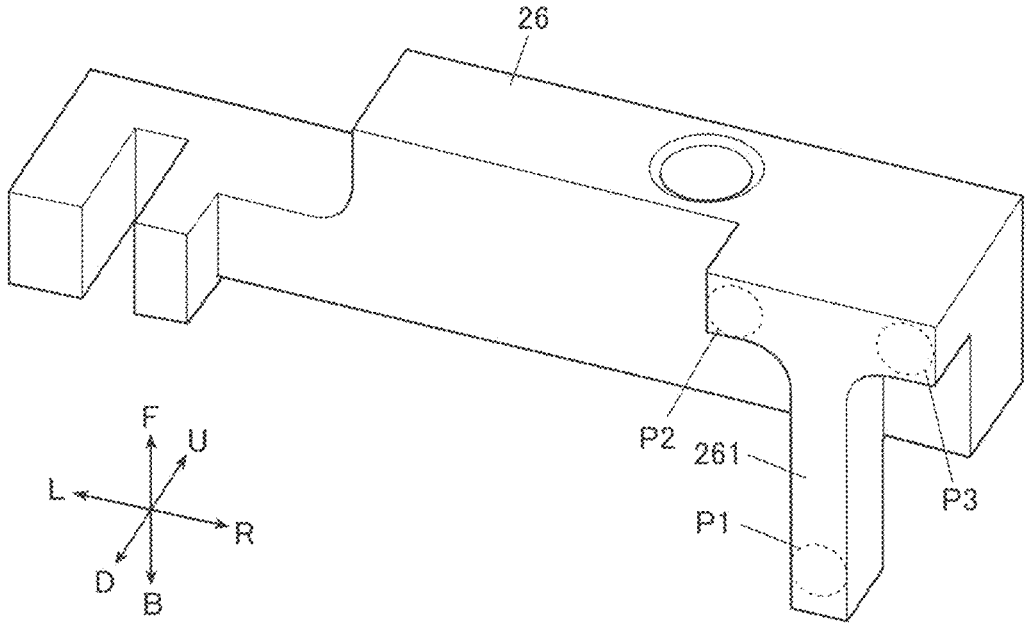
FIG. 11 is a perspective view of a bottom surface side of a slider.

FIG. 11 is a perspective view of a bottom surface side of the slider 26. As illustrated in the figure, the slider 26 includes a collision portion 261 having a T-shaped bottom surface. When the slider 26 is at the left position, a first collision position P1 of a back portion of the collision portion 261 collides with the left clutch lever 21. Then, a second collision position P2 of the front left side of the collision portion 261 collides with the left deactivating member 24. When the slider 26 is at the right position, the first collision position P1 of the back portion of the collision portion 261 collides with the right clutch lever 21. Then, a third collision position P3 of the front right side of the collision portion 261 collides with the right deactivating member 24.

[Needle Bar Switching Mechanism]

As illustrated in FIG. 2, the needle bar switching mechanism 40 is arranged above the sewing machine arm portion 1*a*. The needle bar switching mechanism 40 includes an air cylinder 41, a coupling plate 42 coupling a piston rod of the air cylinder 41 and the slider 26, and a support shaft 43 configured to support the coupling plate 42 such that the coupling plate 42 is movable in the right-to-left direction. The air cylinder 41 moves the slider 26 to any of three positions including the left position, the neutral position, and the right position.

The air cylinder 41 is a three-port two-stroke air cylinder. When the piston rod is retreated to the leftmost side, the position of the slider 26 is determined at the left position. Then, the position of the slider 26 is determined at the neutral position by a first step stroke for advancing rightward. Further, the position of the slider 26 can be determined at the right position by a full stroke for advancing to the rightmost side.

The support shaft 43 is, in a fixed manner, equipped at an upper surface of the sewing machine arm portion 1*a* with the support shaft 43 being along the right-to-left direction. Moreover, the support shaft 43 penetrates an upper end portion of the coupling plate 42, and supports the coupling plate 42 such that the coupling plate 42 is movable in the right-to-left direction.

The upper end portion of the coupling plate 42 is coupled to the piston rod of the air cylinder 41. Moreover, a lower end portion of the coupling plate 42 suspends from the support shaft 43, and is coupled to the slider 26. Thus, advancing/retreating movement operation of the piston rod of the air cylinder 41 can be transmitted to the slider 26.

Note that as described above, the slider 26 is supported by the swinging frame 13 swingable right to left. Thus, the position of the slider 26 fluctuates right to left. However, the coupling plate 42 is formed from a plate spring bendable right to left. Thus, the coupling plate 42 allows fluctuation in the position of the slider 26 in the right-to-left direction.

[Needle Bar Switching Operation]

Needle bar switching operation by the needle bar mechanism 10 will be described with reference to FIGS. 6 to 10.

Initially, the left needle bar 11 is held by the needle bar connecting stud 14. Moreover, the right needle bar 11 is released by the needle bar connecting stud 14. An example of a case where the left needle bar 11 is, from this state, switched to the release state and the right needle bar 11 is switched to the holding state will be described.

The left needle bar 11 is in a state in which the left needle bar 11 moves up and down together with the needle bar connecting stud 14 to perform sewing. At the timing of lowering the needle bar connecting stud 14 to the vicinity of a bottom dead point, the air cylinder 41 of the needle bar switching mechanism 40 is actuated to switch the position of the slider 26 from the right position to the left position.

In this manner, when the needle bar connecting stud 14 is lifted toward the top dead point, the upper end portion of the left clutch lever 21 comes into collision with the first collision position P1 of the slider 26 (FIG. 7).

By collision, the upper end portion of the left clutch lever 21 is pushed down against the clutch spring 211. Then, the left clutch lever 21 rotates. In association with such rotation, the left needle bar clutch 22 advances. Then, the protrusion 221 is pulled out of the fitting hole 112 of the left needle bar 11 (FIG. 8).

In this manner, the lower end portion of the lever member 111 in the needle bar 11 rotates forward, and the upper end portion of the lever member 111 rotates backward. Thus, the left needle bar 11 is held at the upper standby position by the needle bar holding mechanism 60.

At the same time as collision of the left clutch lever 21, the upper end portion of the left deactivating member 24 comes into collision with the second collision position P2 of the slider 26, and is pushed down. In this state, the clearance 242 as the allowance is present between the left deactivating member 24 and the left needle bar clutch stopper 23. Thus, lowering operation is not transmitted to the front end portion of the needle bar clutch stopper 23. Moreover, the back end portion of the needle bar clutch stopper 23 is pressed upward by the stopper spring 232. Thus, when the needle bar clutch 22 advances as illustrated in FIG. 8, the needle bar clutch stopper 23 rotates about the axis. Then, the claw 231 of the needle bar clutch stopper 23 is locked at the groove 222 of the back end portion of the needle bar clutch 22. In this manner, the needle bar clutch 22 is restricted from retreating.

Further, at the same time as collision between the slider 26 and the left deactivating member 24, the interlocking mechanism 25 rotates about the spindle member 252 as a center. Accordingly, the right deactivating member 24 is lifted (FIG. 6), and a state of FIG. 9 transitions to a state of FIG. 10. That is, by lifting of the right deactivating member 24, the front end portion of the right needle bar clutch stopper 23 rotates about the axis with the front end portion being lifted. Then, the claw 231 of the back end portion is detached from the groove 222 of the back end portion of the needle bar clutch 22. In this manner, the needle bar clutch 22 advances, and the protrusion 221 is inserted into the fitting hole 112 of the right needle bar 11 held at the upper standby position by the needle bar holding mechanism 60. In this state, the lower end portion of the lever member 111 in the right needle bar 11 moves backward, and the upper end portion of the lever member 111 moves forward. Thus, the right needle bar 11 is released from the needle bar holding mechanism 60.

Thus, the right needle bar 11 is brought into the holding state by the needle bar connecting stud 14. Thus, switching of the needle bar 11 is performed such that needle handling is performed by upper-to-lower movement of the needle bar 11.

Advantageous Effects of Embodiment

The needle bar mechanism 10 is provided with two deactivating members 24 each corresponding to two needle bars 11. The deactivating member 24 is lifted to deactivate the switching restricted state of the needle bar clutch stopper 23. Moreover, the needle bar mechanism 10 includes the interlocking mechanism 25 interlocking two deactivating members 24 such that these deactivating members 24 move opposite to each other in the upper-to-lower direction. Further, the needle bar mechanism 10 has such a structure that the slider 26 of the needle bar mechanism 10 comes, at the time of lifting of the needle bar connecting stud 14, into collision with the deactivating member 24 corresponding to the needle bar 11, the same one as the clutch lever 21 corresponds to, to push the deactivating member 24 downward.

Thus, when the slider 26 collides with and pushes down the clutch lever 21 and the deactivating member 24 corresponding to one needle bar 11, the other deactivating member 24 is lifted by the interlocking mechanism 25. Thus, for one needle bar 11, the needle bar clutch 22 is pulled out of the fitting hole 112 provided at the one needle bar 11 by rotation of the clutch lever 21 by single collision of the clutch lever 21 and the deactivating member 24 with the slider 26. Moreover, for the other needle bar 11, the restricted state of the needle bar clutch 22 by the needle bar clutch stopper 23 is deactivated by rotation of the deactivating member 24. Thus, switching of the needle bar 11 held by the needle bar connecting stud 14 can be performed by collision due to single lifting of the needle bar connecting stud 14.

Moreover, occurrence of simultaneous needle location of two needle bars 11 can be avoided. Thus, the needle bar mechanism 10 is specifically effective for a case where alternative needle location of two sewing needles 12 at the single pinhole 3 is performed as in the sewing machine 1.

The clearance 242 as the allowance for downward movement of the deactivating member 24 relative to the needle bar clutch stopper 23 is provided between the deactivating member 24 and the needle bar clutch stopper 23. Thus, when the deactivating member 24 comes into collision with the slider 26, the deactivating member 24 does not collide with the needle bar clutch stopper 23 because of the clearance 242. This can avoid a great load between the deactivating member 24 and the needle bar clutch stopper 23. Thus, occurrence of damage and deformation of the member can be reduced.

The compression spring 243 as the elastic body is interposed in the clearance 242 as the allowance. Thus, rattling of the needle bar clutch stopper 23 due to the clearance 242 can be reduced.

The interlocking mechanism 25 includes the link member 251 having, at the center portion thereof, the spindle member 252 as the point of support. Moreover, one end portion and the other end portion of the link member are each coupled to the separate deactivating members 24. The interlocking mechanism 25 has such a simple configuration, so that operation stability can be improved.

[Other]

Figure 12:
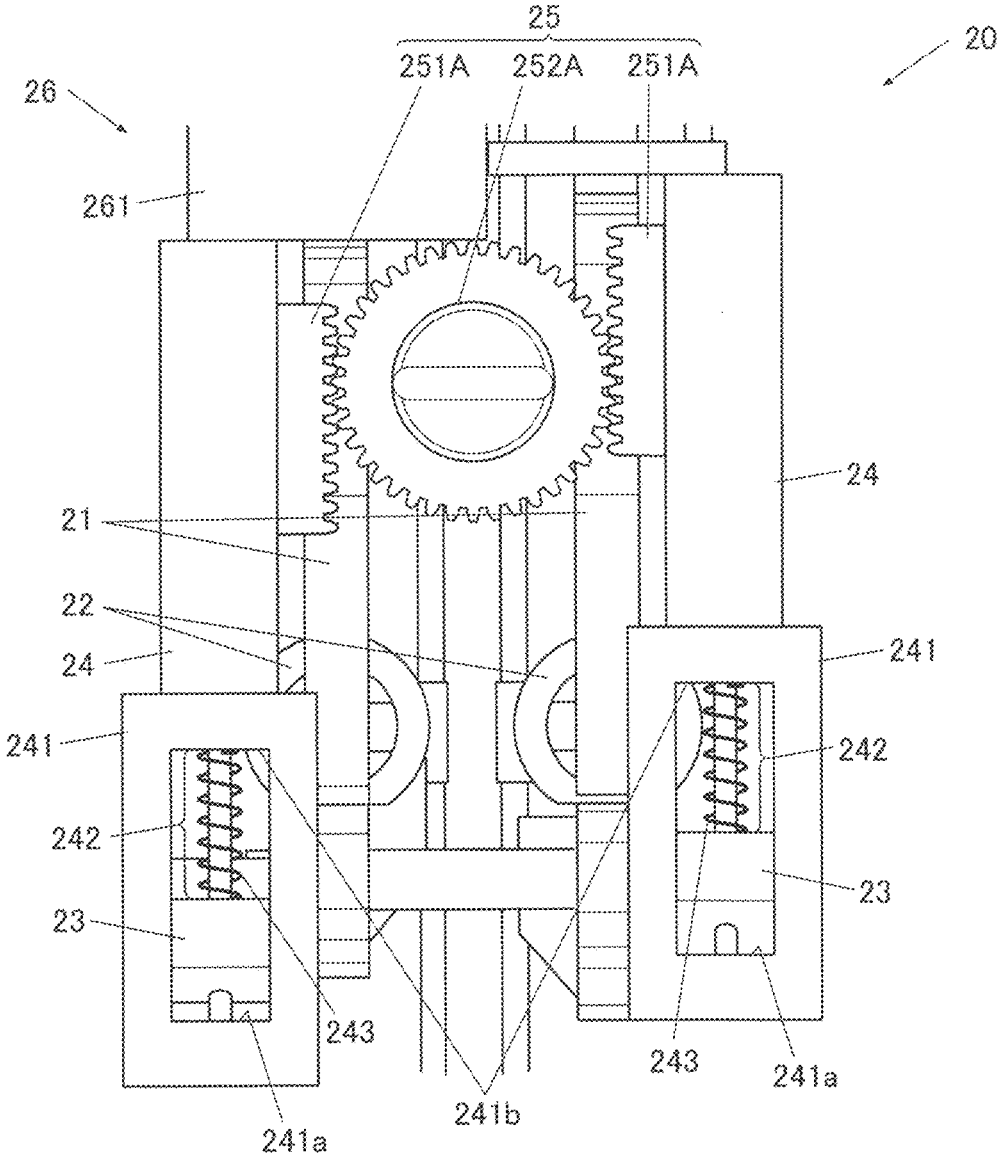
FIG. 12 is a front view of another example of an interlocking mechanism.
Figure 13:
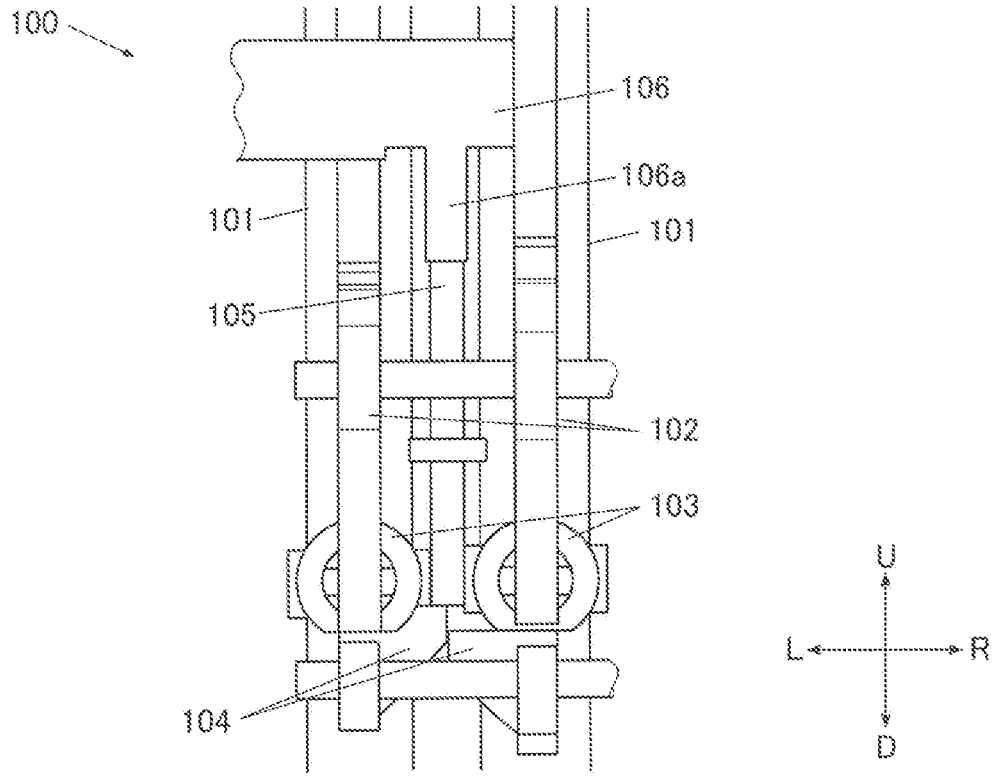
FIG.13 PRIOR ART
FIG. 13 is a front view when a typical clutch mechanism switches a left needle bar from a release state to a holding state.
Figure 14:
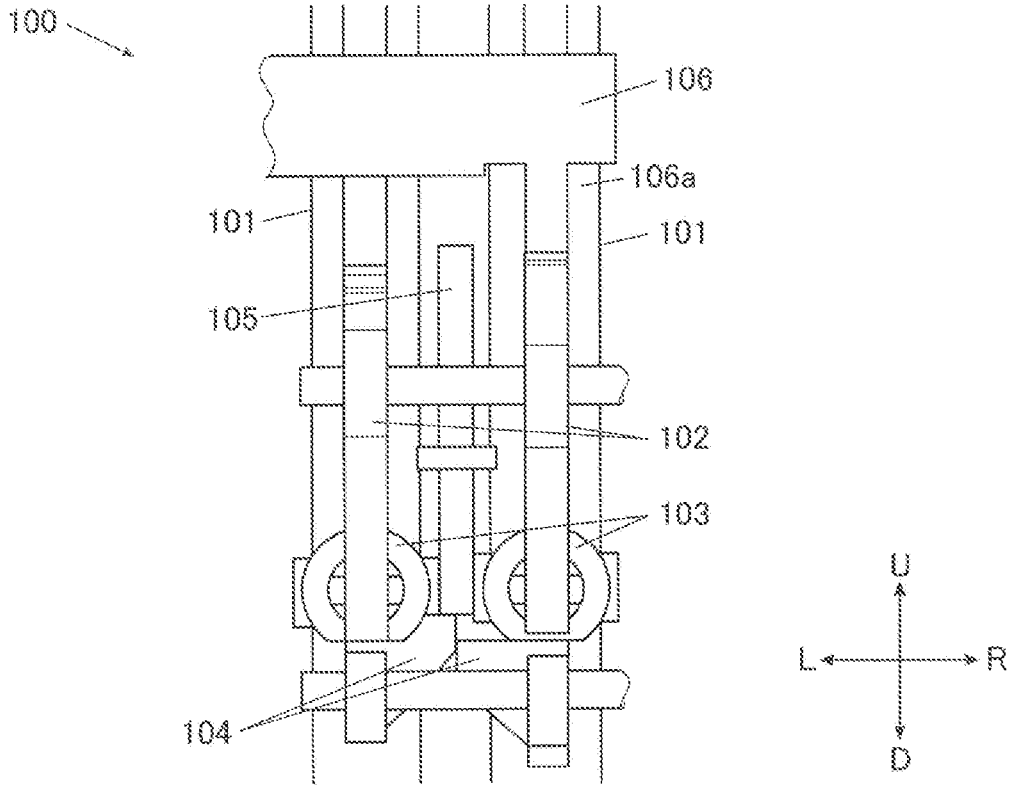
FIG.14 PRIOR ART
FIG. 14 is a front view when the typical clutch mechanism switches a right needle bar from the holding state to the release state.
Figure 15:
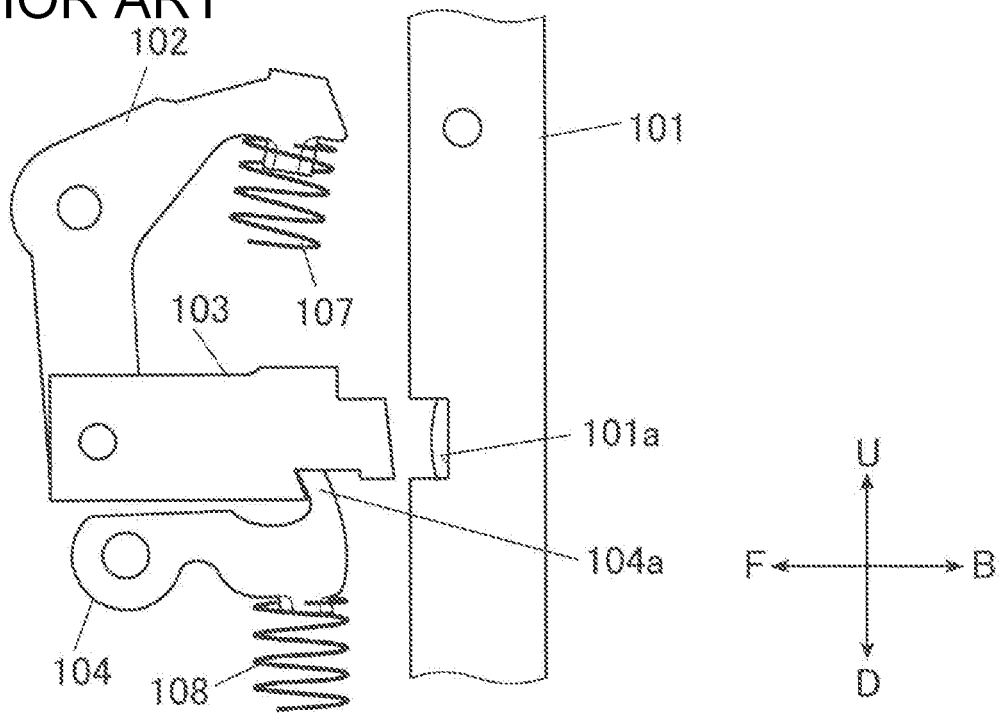
FIG.15 PRIOR ART
FIG. 15 is a side view of the typical clutch mechanism in the release state.
Figure 16:
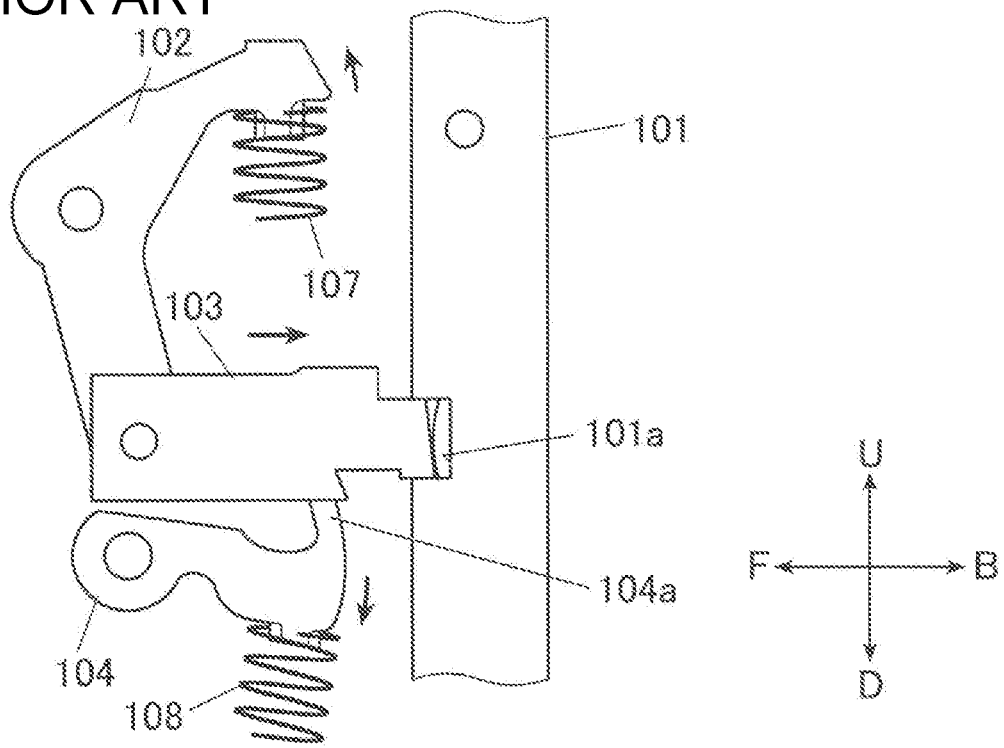
FIG.16 PRIOR ART
FIG. 16 is a side view of the typical clutch mechanism switched from the release state to the holding state.
Figure 17:
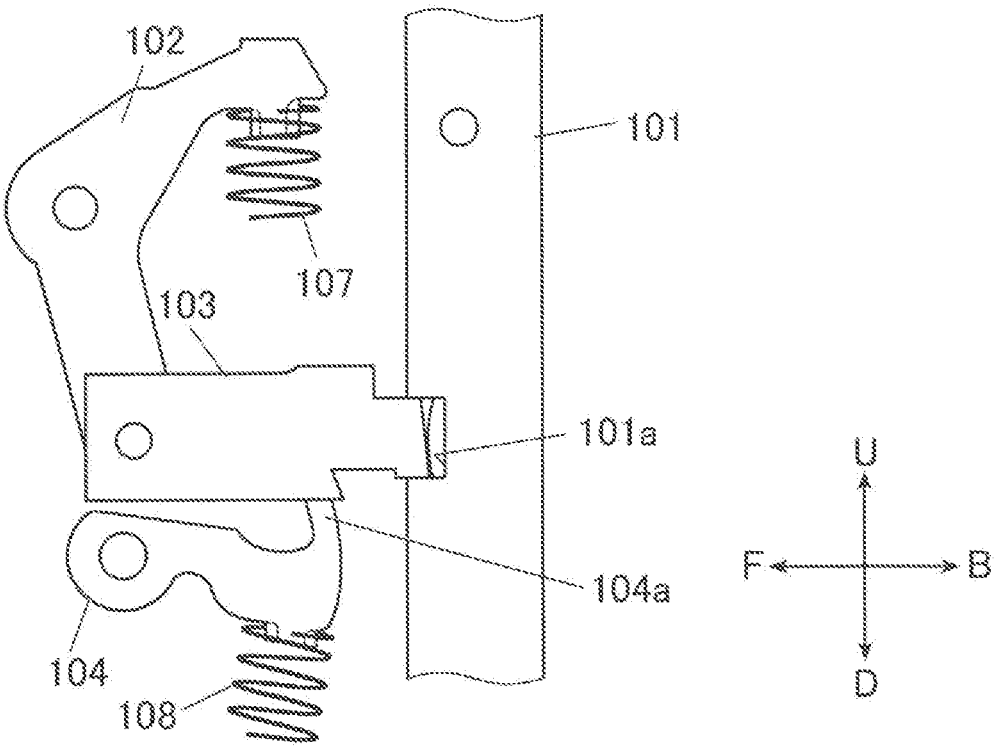
FIG.17 PRIOR ART
FIG. 17 is a side view of the typical clutch mechanism in the holding state.
Figure 18:
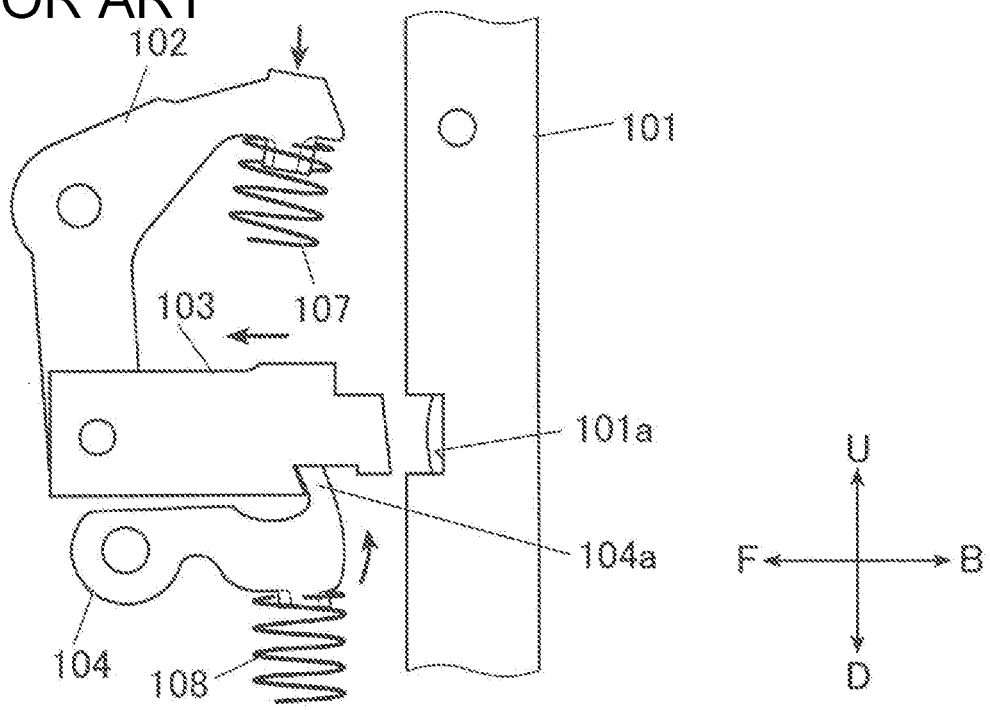
FIG.18 PRIOR ART
FIG. 18 is a side view of the typical clutch mechanism switched from the holding state to the release state.

As long as the interlocking mechanism can move two deactivating members 24 opposite to each other in the upper-to-lower direction, other structures may be employed. For example, a configuration including rack gears 251A and a pinion gear 252A between two deactivating members 24 as in an interlocking mechanism 25A illustrated in FIG. 12 may be employed. In this configuration, the rack gears 251A are arranged such that tooth tips thereof face each other. Moreover, the pinion gear 252A engages with both of the rack gears 251A between the rack gears 251A on the right and left sides of the pinion gear 252A.

In this case, when the slider 26 comes into collision with and pushes down one deactivating member 24, the pinion gear 252A engaging the rack gear 251A of such a deactivating member 24 rotates. Then, the deactivating member 24 can be pushed up together with the other rack gear 251A.

In the above-described embodiment, the needle bar switching mechanism 40 is configured to move the slider 26 to any of three positions including the left position, the neutral position, and the right position. Note that it may be configured such that the slider 26 is moved to any of only two positions including the left position and the right position.

The needle bar mechanism of the sewing machine of the present disclosure may be the following first to sixth needle bar mechanisms of the sewing machine.

The first needle bar mechanism of the sewing machine includes a needle bar connecting stud; two needle bars; needle bar clutches 22, clutch levers 21, needle bar clutch stoppers 23, and deactivating members 24 provided, two by two, corresponding to two needle bars at the needle bar connecting stud 14; and a slider 26 configured to selectively collide, at the time of lifting of the needle bar connecting stud 14, with the clutch lever 21 and the deactivating member 24 corresponding to either one of the needle bars 11. The needle bar clutch 22 is configured such that the needle bar 11 is brought into a holding state at the needle bar connecting stud 14 by fitting into a fitting hole 112 provided at the needle bar 11. The clutch lever 21 is, at a center portion thereof, rotatably supported by the needle bar connecting stud 14. One end of the clutch lever 21 is biased upward by a clutch spring 211, and another end of the clutch lever 21 is coupled to the needle bar clutch 22. By rotation operation, switching is made to a release state in which the needle bar clutch 22 is separated from the fitting hole 112. The needle bar clutch stopper 23 is, at a center portion thereof, rotatably supported by the needle bar connecting stud 14. One end of the needle bar clutch stopper 23 is inserted into a frame portion 241 provided at the deactivating member 24, and another end of the needle bar clutch stopper 23 has a claw 231 and is biased toward the needle bar clutch by a stopper spring 232. The claw 231 is locked at a groove 222 provided at the needle bar clutch 22 to restrict switching from the release state to the holding state of the needle bar clutch 22. The deactivating member 24 is configured such that the claw 231 is separated from the groove 222 to deactivate a switching restricted state in such a manner that the needle bar clutch stopper 23 is rotated by contact between one end of the needle bar clutch stopper 23 and an inner side lower portion 241*a* of the frame portion 241 at the time of lifting of the deactivating member 24. An interlocking mechanism 25 is provided to interlock two deactivating members 24 such that two deactivating members 24 move opposite to each other in the upper-to-lower direction. When one end of the clutch lever 21 and the deactivating member 24 corresponding to one needle bar 11 selectively collided with the slider 26 at the time of lifting of the needle bar connecting stud 14 are pushed downward, the clutch lever 21 corresponding to one needle bar 11 rotates the needle bar clutch 22 in the direction of separating the needle bar clutch 22 from the fitting hole 112, thereby bringing the needle bar clutch 22 into the release state. Moreover, the deactivating member 24 corresponding to the other needle bar 11 is lifted by the interlocking mechanism 25, thereby deactivating the switching restricted state by the needle bar clutch stopper 23.

The second needle bar mechanism of the sewing machine is the first needle bar mechanism of the sewing machine, in which the clutch spring 211 biases such that the clutch lever 21 rotates in the direction of bringing the needle bar clutch 22 into the holding state.

The third needle bar mechanism of the sewing machine is the first or second needle bar mechanism of the sewing machine, in which a clearance 242 as an allowance is provided inside the frame portion 241 such that the deactivating member 24 is movable downward without contact between the inner side upper portion 241*b* of the frame portion 241 and one end of the needle bar clutch stopper 23.

The fourth needle bar mechanism of the sewing machine is any one of the first to third needle bar mechanisms of the sewing machine, in which a compression spring 243 is interposed in the clearance 242 as the allowance.

The fifth needle bar mechanism of the sewing machine is any one of the first to fourth needle bar mechanisms of the sewing machine, in which the interlocking mechanism is configured such that two deactivating members 24 are separately coupled to one end portion and the other end portion of the link member 251 having the point of support at the center thereof.

The sixth needle bar mechanism of the sewing machine is any one of the first to fourth needle bar mechanisms of the sewing machine, in which the interlocking mechanism has rack gears each provided at two deactivating members and a gear configured to engage both of two rack gears arranged facing in parallel to each other.

The invention claimed is:

1. A needle bar mechanism of a sewing machine, comprising:

a needle bar connecting stud;

two needle bars;

a slider; and an interlocking mechanism, wherein the needle bar connecting stud includes, corresponding to the two needle bars, two needle bar clutches, two clutch levers, two needle bar clutch stoppers, and two deactivating members, the slider is configured to selectively collide, at the time of lifting of the needle bar connecting stud, with the clutch lever and the deactivating member corresponding to either one of the two needle bars, thereby pushing down the clutch lever and the deactivating member, each needle bar clutch is configured such that the needle bar is held by the needle bar connecting stud by fitting of the needle bar clutch into a fitting hole provided at the needle bar, each clutch lever is, at a center portion thereof, rotatably supported by the needle bar connecting stud, one end of each clutch lever is biased upward by a clutch spring, another end of each clutch lever is coupled to the needle bar clutch, each clutch lever is configured such that when the clutch lever is selectively pushed down by the slider, the needle bar clutch fitted in the fitting hole is separated from the fitting hole by rotation operation of the clutch lever, each needle bar clutch stopper is, at a center portion thereof, rotatably supported by the needle bar connecting stud, one end of each needle bar clutch stopper is inserted into a frame portion provided at the deactivating member, another end of each needle bar clutch stopper has a claw, and is biased toward the needle bar clutch by a stopper spring, each needle bar clutch stopper is configured such that when the corresponding deactivating member is selectively pushed down by the slider, the claw is locked at a groove provided at the needle bar clutch to restrict movement of the needle bar clutch into the fitting hole, each deactivating member is configured such that the claw locked at the groove is separated from the groove by the rotating needle bar clutch stopper rotated by contact between one end of the needle bar clutch stopper and an inner side lower portion of the frame portion at the time of lifting of the deactivating member, and the interlocking mechanism is configured to interlock the two deactivating members such that one of the deactivating members is lifted when the other deactivating member is selectively pushed down.

2. The needle bar mechanism of the sewing machine according to claim 1, wherein the clutch spring biases such that the clutch lever rotates in a direction where the needle bar clutch is fit into the fitting hole provided at the needle bar.

3. The needle bar mechanism of the sewing machine according to claim 2, wherein a clearance as an allowance is provided inside the frame portion such that the deactivating member is movable downward without contact between the inner side upper portion of the frame portion and one end of the needle bar clutch stopper.

4. The needle bar mechanism of the sewing machine according to claim 3, wherein a compression spring is interposed in the clearance as the allowance.

5. The needle bar mechanism of the sewing machine according to claim 4, wherein the interlocking mechanism includes a link member, the link member has a point of support at a center thereof, and has a first end portion and a second end portion, and the first and second end portions are each coupled to the corresponding deactivating members.

6. The needle bar mechanism of the sewing machine according to claim 4, wherein the interlocking mechanism has two rack gears facing in parallel to each other and each arranged at the two deactivating members, and a gear configured to engage both of the rack gears.

7. The needle bar mechanism of the sewing machine according to claim 3, wherein the interlocking mechanism includes a link member, the link member has a point of support at a center thereof, and has a first end portion and a second end portion, and the first and second end portions are each coupled to the corresponding deactivating members.

8. The needle bar mechanism of the sewing machine according to claim 3, wherein the interlocking mechanism has two rack gears facing in parallel to each other and each arranged at the two deactivating members, and a gear configured to engage both of the rack gears.

9. The needle bar mechanism of the sewing machine according to claim 2, wherein the interlocking mechanism includes a link member, the link member has a point of support at a center thereof, and has a first end portion and a second end portion, and the first and second end portions are each coupled to the corresponding deactivating members.

10. The needle bar mechanism of the sewing machine according to claim 2, wherein the interlocking mechanism has two rack gears facing in parallel to each other and each arranged at the two deactivating members, and a gear configured to engage both of the rack gears.

11. The needle bar mechanism of the sewing machine according to claim 1, wherein a clearance as an allowance is provided inside the frame portion such that the deactivating member is movable downward without contact between the inner side upper portion of the frame portion and one end of the needle bar clutch stopper.

12. The needle bar mechanism of the sewing machine according to claim 11, wherein a compression spring is interposed in the clearance as the allowance.

13. The needle bar mechanism of the sewing machine according to claim 12, wherein the interlocking mechanism includes a link member, the link member has a point of support at a center thereof, and has a first end portion and a second end portion, and the first and second end portions are each coupled to the corresponding deactivating members.

14. The needle bar mechanism of the sewing machine according to claim 12, wherein the interlocking mechanism has two rack gears facing in parallel to each other and each arranged at the two deactivating members, and a gear configured to engage both of the rack gears.

15. The needle bar mechanism of the sewing machine according to claim 11, wherein the interlocking mechanism includes a link member, the link member has a point of support at a center thereof, and has a first end portion and a second end portion, and the first and second end portions are each coupled to the corresponding deactivating members.

16. The needle bar mechanism of the sewing machine according to claim 11, wherein the interlocking mechanism has two rack gears facing in parallel to each other and each arranged at the two deactivating members, and a gear configured to engage both of the rack gears.

17. The needle bar mechanism of the sewing machine according to claim 1, wherein the interlocking mechanism includes a link member, the link member has a point of support at a center thereof, and has a first end portion and a second end portion, and the first and second end portions are each coupled to the corresponding deactivating members.

18. The needle bar mechanism of the sewing machine according to claim 1, wherein the interlocking mechanism has two rack gears facing in parallel to each other and each arranged at the two deactivating members, and a gear configured to engage both of the rack gears.

* * * * *